United States Patent [19]

Apotheloz

[11] 4,419,934

[45] Dec. 13, 1983

[54] SAFETY APPARATUS FOR A SPINNING PROJECTILE FUSE

[75] Inventor: Robert Apotheloz, Greifensee, Switzerland

[73] Assignee: Werkzeugmaschinenfabrik Oerlikon-Bührle AG, Zurich, Switzerland

[21] Appl. No.: 289,294

[22] Filed: Aug. 3, 1981

[30] Foreign Application Priority Data

Aug. 28, 1980 [CH] Switzerland ..... 6485/80
Jun. 9, 1981 [CH] Switzerland ..... 3792/81

[51] Int. Cl.[3] ..... F42C 15/26

[52] U.S. Cl. ..... 102/233; 102/235; 102/249

[58] Field of Search ..... 102/231–233, 102/235, 236, 249

[56] References Cited

U.S. PATENT DOCUMENTS

| | | | |
|---|---|---|---|
| 2,448,121 | 8/1948 | Porter | 102/239 |
| 2,625,881 | 1/1953 | Rabinow | 102/251 |
| 3,465,676 | 9/1969 | Simmen | 102/233 |
| 3,763,785 | 10/1973 | Briggs et al. | 102/256 |
| 3,985,079 | 10/1976 | Post et al. | 102/235 |
| 4,020,766 | 5/1977 | Moyse | 102/231 |
| 4,154,169 | 5/1979 | Petiteau | 102/233 |

FOREIGN PATENT DOCUMENTS

| | | | |
|---|---|---|---|
| 1927911 | 12/1970 | Fed. Rep. of Germany . | |
| 662049 | 11/1951 | United Kingdom | 102/233 |

*Primary Examiner*—David H. Brown
*Attorney, Agent, or Firm*—Werner W. Kleeman

[57] ABSTRACT

A safety apparatus for a spinning projectile fuze comprises a rotor with which there is operatively associated a toothed segment which, under the action of the spin, drives a retarding or restraining mechanism and following expiration of the action of the retarding mechanism moves the rotor into its armed or live position. The safety apparatus further comprises a spin safety element and an acceleration-spin safety element. The acceleration-spin safety element contains a ball displaceable by the action of the firing acceleration, and a disc member, and the spin safety element possesses a piston displaceable by the action of the projectile spin in order to release the rotor.

11 Claims, 25 Drawing Figures

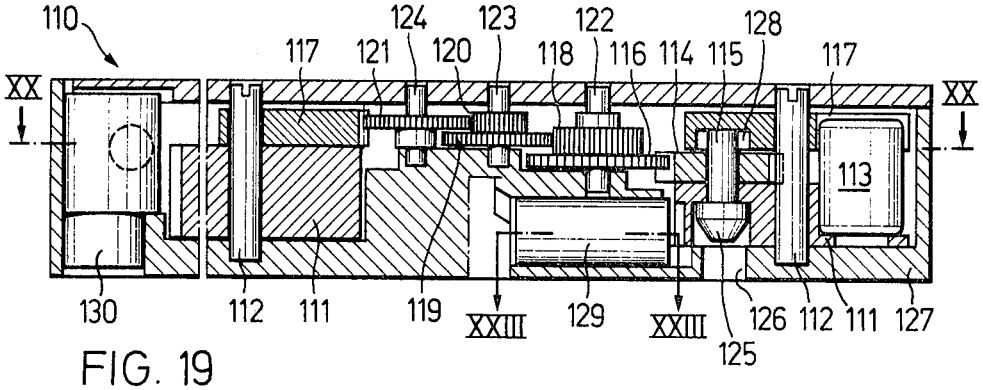
FIG. 19
FIG. 20
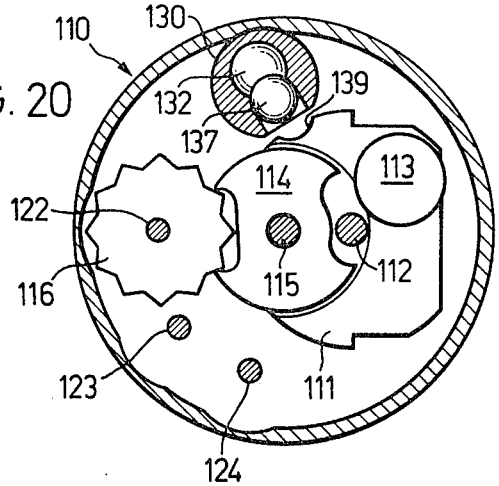
FIG. 21
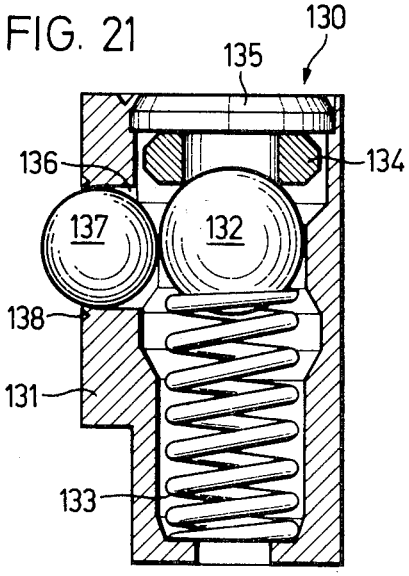
FIG. 22
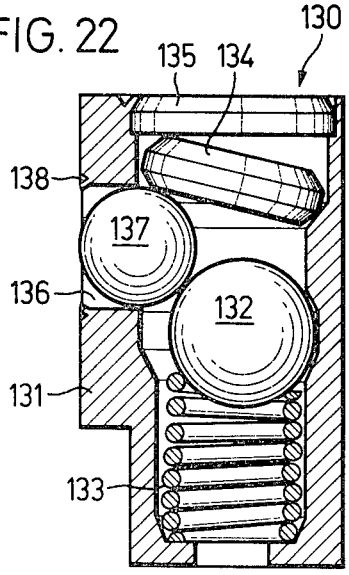

SAFETY APPARATUS FOR A SPINNING PROJECTILE FUSE

BACKGROUND OF THE INVENTION

The present invention relates to a new and improved construction of a safety apparatus for a spinning projectile fuze.

Generally speaking, the safety apparatus of the present development is of the type comprising a rotor which, upon firing of the projectile, can be moved out of a safety position into an armed or live position and the axis of which is mounted externally of the spin axis of the projectile. A retarding or restraining mechanism is also provided which releases the rotor, following firing of the projectile and after a certain time-delay in order to allow it to rotate into the armed or live position. A first safety element is responsive to the firing acceleration and to the spin and serves to release the rotor in order to enable it to rotate into the live position, whereas a second safety element, responsive to the spin of the projectile, serves to release the rotor to enable it to rotate into the armed or live position.

Different requirements are placed upon a safety apparatus for a fuze and as to the more important ones they can be enumerated as follows:

The interruption of a firing or ignition chain in the fuze must be accomplished such that the first element of the ignition chain, until releasing the safety, must be separated by at least one blocking device or safety apparatus from the transmission charge and the reinforcement charge. The safety apparatus must be directly mechanically lockable by means of at least two independently operating safety elements. Each safety element must be actuated by at least one environmental force which does not act upon the other safety element. If the ignition chain is not positively interrupted because the safety or blocking apparatus is missing, then the fuze must be designed in a manner such that it is impossible to assemble the fuze without the blocking or locking element.

There are known to the art quite a number of safety apparatuses of this type. Attention is specifically directed to Swiss Pat. No. 531,159 wherein there is provided a rotor which is operatively connected with a retarding mechanism. However, this state-of-the-art arrangement is afflicted with the drawback that the rotor already begins to rotate at such time as the restraining mechanism begins to operate. This prior art apparatus furthermore possesses a safety element which is responsive to the firing acceleration. This known safety element, however, possesses the drawback that it exclusively responds to firing acceleration and not additionally to the projectile spin.

Furthermore, there is known from German Pat. No. 2,247,709 a safety apparatus of this type which likewise possesses a rotor which is operatively connected with a restraining mechanism. The rotor first can begin to rotate when the action of the restraining mechanism has expired. What is disadvantageous with this known arrangement is, however, that the restraining or retarding mechanism possesses a swinging or oscillatory armature, the pivot axis of which is located externally of the spin axis of the projectile. Consequently, there is not ensured or reliable functioning of the restraining mechanism.

SUMMARY OF THE INVENTION

Therefore, with the foregoing in mind it is a primary object of the present invention to provide a new and improved construction of safety apparatus for a spinning projectile fuze, which is not afflicted with the aforementioned drawbacks and limitations of the prior art constructions heretofore discussed.

Another and more specific object of the present invention aims at providing a safety apparatus wherein, by appropriately suitably combining the individual elements, all of the heretofore stated requirements placed upon such safety apparatus are fulfilled to as great an extent as possible.

Yet a further significant object of the present invention aims at providing a new and improved construction of safety apparatus for a spinning projectile fuze, which is relatively simple in construction and design, economical to manufacture, extremely reliable in operation, not readily subject to breakdown or malfunction and affords enhanced security.

Now in order to implement these and still further objects of the invention, which will become more readily apparent as the description proceeds, the safety apparatus of the present development is manifested by the features that it is arranged in a housing which can be incorporated or installed as an entity or unit in the spinning projectile fuze. The safety elements likewise are arranged in a housing which can be assembled as a unit or entity in the safety apparatus. All of the elements can be non-destructively tested by carrying out a function control.

Significant advantages of this safety apparatus reside in the fact that the safety elements, prior to their assembly in the safety apparatus, can be finished mounted, and that the safety apparatus, prior to its assembly in the spinning projectile fuze, can be finished mounted.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 19 is the same sectional view along the line XVI—XVI of FIG. 17 showing the arrangement in a partially armed or live position;

FIG. 20 is a sectional view along the line XX—XX of FIG. 19;

FIG. 21 is a sectional view taken along the line XXI—XXI of FIG. 17 through an acceleration safety element in the safety position or state;

FIG. 22 is the same sectional view taken along the line XXI—XXI of FIG. 17 showing the arrangement in the armed position;

DETAILED DESCRIPTION OF THE PREFERRED EMBODIMENTS

Figure 1:
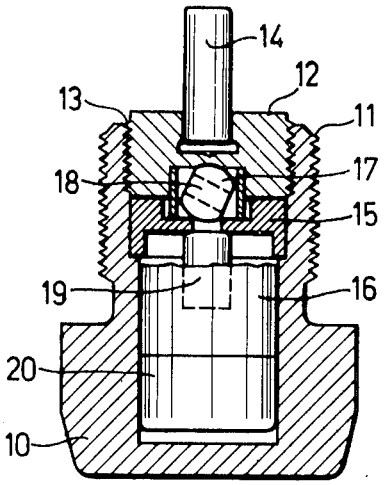
FIG. 1 PRIOR ART
FIG. 1 is a longitudinal sectional view through a prior art base fuze.

Describing now the drawings, according to FIG. 1 a conventional base fuze will be seen to possess a housing 10 which is threaded by means of its external threads 11 or the like into the rear end of a not particularly illustrated projectile body or projectile. This housing 10 is closed by a cover member 12 which can be threaded into internal threads 13 of the housing 10. At this cover member or cover 12 there is secured a reinforcement charge 14 which protrudes into the not particularly illustrated explosive charge contained internally of the projectile body. Beneath the cover member 12 there is located a plate member 15 at which there is affixed the electronic elements 16 of the fuze. Additionally, there is arranged above the plate member 15 a rotor 17 equipped with a detonator cap 18. Beneath the rotor 17 there is provided a further detonator cap 19. In order to fire such detonator cap 19 there is provided a current generator or a current storage 20.

The construction and mode of operation of the base fuze shown in FIG. 1 is not new and the fuze is here only illustrated and described as background in order to render clear the location where the inventively constructive rotor 17 is located in the fuze.

Figure 2:
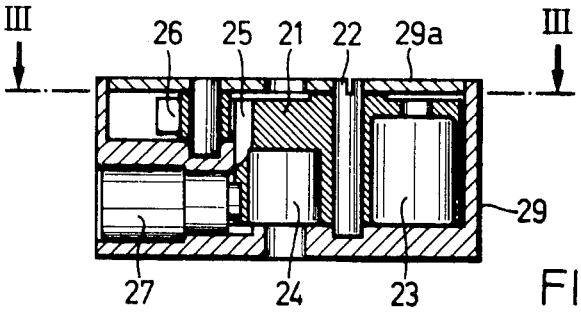
FIG. 2 is a sectional view, taken along the line II—II of FIG. 3, through a first exemplary embodiment of a safety apparatus for the base fuze depicted in FIG. 1.
Figure 3:
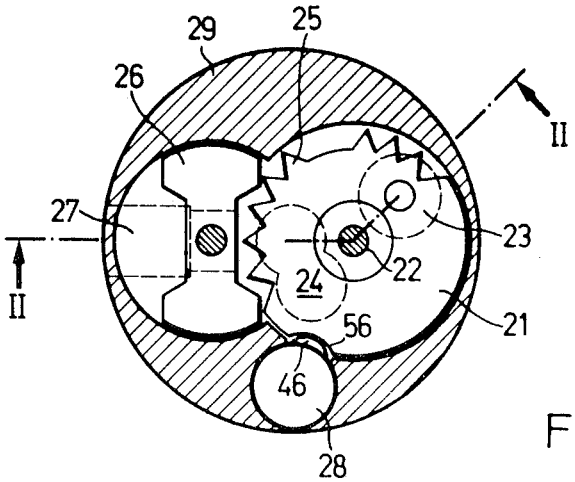
FIG. 3 is a sectional view taken along the line III—III of FIG. 2.

Turning attention now to FIGS. 2 and 3 the inventive safety apparatus will be seen to comprise a housing 29 which is closed by a cover or cover member 29*a*. Internally of the housing 29 there is mounted for rotation about a vertical shaft 22 a rotor 21 which corresponds to the rotor 17 of the prior art arrangement illustrated and described above with reference to FIG. 1. This rotor 21 contains a detonator cap 23 and an inertia body or mass 24, in order to shift the centre of gravity of the rotor 21 externally of the axis of rotation. Rotor 21 possesses a toothed arrangement or toothed segment 25 which coacts with a restraining or retarding mechanism 26, in order to delay rotation of the rotor 21. Additionally, there are provided housing means for two safety elements 27 and 28 which prevent any premature rotation of the rotor 21 about its own axis 22. The rotor 21 is located in its armed position when the detonator cap 23 is located in the projectile axis. The first safety element 27 only responds to projectile spin, i.e. this element releases the rotor 21 as soon as, upon firing of the projectile, the spin of the projectile has reached a threshold value. Therefore, this safety element 27 will be conveniently referred to in this disclosure as the spin safety element. The second safety element 28 responds to the projectile acceleration, i.e. this element 28 releases the rotor 21 as soon as, following firing of the projectile, the acceleration of the projectile has reached a threshold value. Therefore, this safety element 28 will be conveniently referred to in this disclosure as the acceleration safety element. The first safety element 27, i.e. the spin safety element, will be described more fully hereinafter in conjunction with FIGS. 4 to 6 and the acceleration safety element 28 will be described more fully hereinafter in conjunction with FIGS. 7 to 10.

Figure 4:
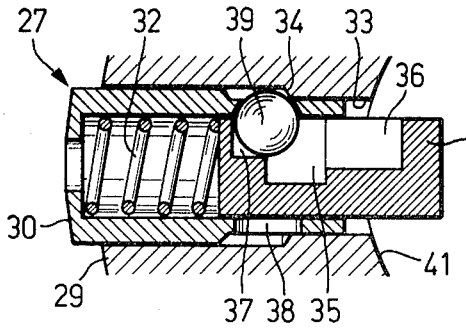
FIG. 4 is a longitudinal sectional view through a spin safety element of the safety apparatus according to FIGS. 2 and 3.
Figure 5:
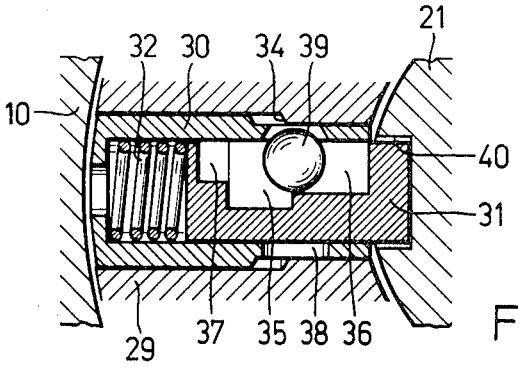
FIGS. 5 and 6 respectively show in different positions the spin safety element depicted in FIG. 4.
Figure 6:
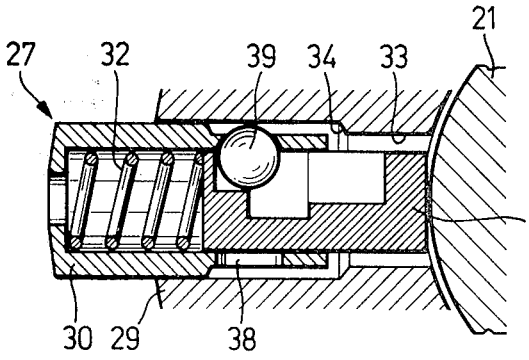

According to FIGS. 4 to 6 the spin safety element 27 is contained in a housing member forming a sleeve member 30 in which there is displaceably guided a piston member or piston 31. A spring 32 strives to shift the piston 31 within the sleeve 30 towards the right of the showing of FIG. 4. This spring 32 bears at one end at the not particularly referenced base of the sleeve member or sleeve 30 and at its other end at the end surface or face of the piston 31. The left end of the sleeve 30 has a larger external diameter than its right end. The sleeve 30 is located in a bore 33 of the housing 29, as will be seen by referring to FIG. 4. This bore 33 likewise is provided at its left end, in accordance with the sleeve 30, with a larger internal diameter than at its right end. The bore 33 therefore will be seen to contain a shoulder 34, as evident by referring to FIGS. 4 to 6. The piston 31 possesses three recesses 35, 36 and 37. The intermediate recess 35 is located lowest, the right-hand recess 36 is less deeply located and the left-hand recess 37 is still less deeply located. The sleeve 30 possesses a transverse bore 38 which is of conical configuration at one end and allows partial penetration of a ball or spherical member 39.

According to the showing of FIG. 4 the ball 39 protrudes out of the sleeve member 30 and bears at the shoulder 34 of the bore 33 in the housing 29 when it is located in the least deep recess 37 of the piston 31. If, however, according to the showing of FIG. 5 the ball or spherical member 39 is located in the less deep recess 36, i.e. the recess at the right-hand portion of the piston 31, then it still protrudes into the bore 38 of the sleeve member or sleeve 30, but not out of the sleeve 30 and therefore also no longer impacts against the shoulder 34. However, if the ball member 39 is located in the deepest recess 35, then it no longer protrudes into the bore 38 of the sleeve 30, so that the spring 32 is in a position for completely displacing the piston 31 out of the sleeve 30. In the showing of FIG. 4 the rotor 21 is missing and the piston 31, during the assembly work, can penetrate to such an extent into the recess 41 of the housing 29 which is provided for the rotor 21, until the ball 39 bears at the shoulder 34 of the bore 33 of the housing 29.

As will be seen from the showing of FIG. 5 the piston 31 protrudes into a blindhole bore 40 of the rotor 21 and, according to the showing of FIG. 6, the piston 31 bears against an improperly inserted rotor 21.

The mode of operation of this spin safety element is as follows:

In the event that the rotor 21 has erroneously not been inserted into the housing 29 during the assembly work, then it is also not possible to insert the spin safety element 27, since upon displacement of the safety element 27 into the bore 33 of the housing 29 the ball 39 bears against the shoulder 34 and prevents a complete insertion of the sleeve member 30, as will be apparent by referring to FIG. 4. However, if as shown in FIG. 5 the rotor 21 has been properly assembled, then also the spin safety element 27 can be completely introduced into the housing 29. This housing 29 of the rotor 21 then also can be mounted in the fuze housing 10. If, however, the rotor 21 has been improperly mounted in the housing 29, then the safety element 27 cannot be inserted as usual, since in doing so it would be necessary to compress together the spring 32 more intensely than otherwise would be the case, as will be seen from FIG. 6 in which, however, the spring 32 has been shown in its completely relaxed condition.

After firing of the projectile the piston 31, due to the projectile spin, is shifted towards the left (FIG. 5)—and the ball 39 allows such to happen—to such an extent that it no longer protrudes into the blindhole bore 40, so that the rotor 21 can freely rotate until it arrives at its armed or live position in conventional manner.

Figure 7:
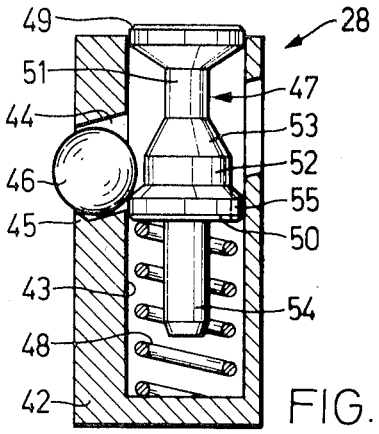
FIG. 7 is a longitudinal sectional view through a first exemplary embodiment of an acceleration safety element.

According to the showing of FIG. 7 the acceleration safety element 28 possesses a housing member forming a substantially cylindrical housing 42 having a non-continuous eccentric longitudinal bore 43 as well as an inclined continuous transverse bore 44. At the left lower end of the transverse bore 44 there is provided a cam or camming surface 45 or equivalent structure which prevents that a ball or spherical member 46 located in the transverse bore 44 can drop out. In the non-continuous lengthwise or longitudinal bore 43 there is arranged a piston member or piston 47. A spring 48 strives to upwardly displace the piston 47. This piston 47 has the same diameter as the longitudinal bore 43 at its upper piston end 49 and at its intermediate or central portion 50. Between the upper end 49 and the intermediate portion 50 of the piston 47 there are provided two piston portions 51 and 52 of different diameter which are interconnected by means of a conical piston portion 53. The transition from the upper piston portion 51 to the end 49 as well as the transition from the lower piston portion or part 52 to the intermediate or central portion 50 are likewise of conical configuration. Protruding downwardly from the central portion 50 is a guide bolt 54 for the spring 48. This central portion 50 also is provided with a groove 55 which is necessary for assembly.

In order to assemble this acceleration safety element 28 initially the spring 48 is inserted into the lengthwise or longitudinal bore 43 until it bears against the base of the longitudinal bore 43. Thereafter, the ball or spherical member 46 is rolled into the transverse bore 44 until it bears against the camming surface or nose 45. Now the piston 47 is inserted into the longitudinal bore 43, and the groove 55 is located at the region of the ball 46. Thereafter, when the central portion 55 of the piston 47 is located below the ball 46 the piston 47 is rotated through an angle of 180° about its lengthwise axis, so that it arrives at the illustrated position. The central portion 50 of the piston 47 then bears at the ball 46 and the piston 47 is pressed by the spring 48 against the ball 46. This ball 46 protrudes into a recess 56 of the rotor 21, as shown in FIG. 3.

The operation of the described acceleration safety element 28 is as follows:

Due to the firing acceleration the piston 47 is displaced against the force of the spring 48 of FIG. 7 to such an extent downwardly that the upper piston portion 51 is located at the region of the ball 46. At the same time the ball 46 is pressed against the rotor 21 into the inclined bore 44. Due to the projectile spin the ball 46 is now pressed against the piston portion or part 51 and therefore no longer protrudes out of the housing member 42. As long as the ball 46 is located in the position of FIG. 7 then it protrudes into the recesss 56 of the rotor 21, and as soon as it is pressed against the piston part or portion 51 it releases the rotor 21 and such can then rotate into its armed or live position.

Figure 8:
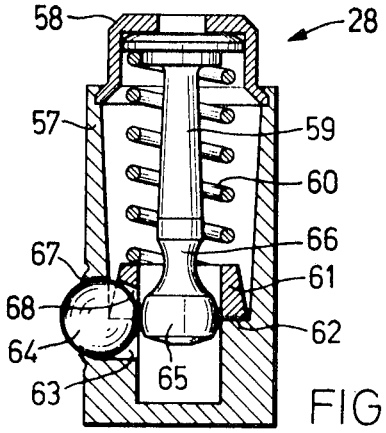
FIG. 8 is a longitudinal sectional view through a second exemplary embodiment of an acceleration safety element.
Figure 9:
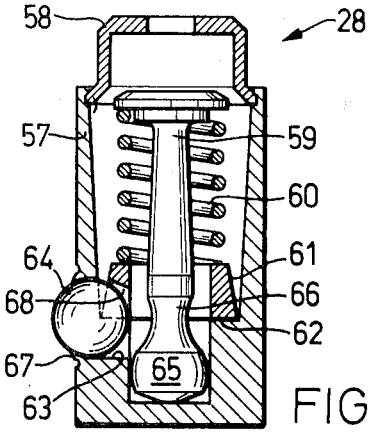
FIGS. 9 and 10 illustrate in different positions the acceleration safety element shown in FIG. 8.
Figure 10:
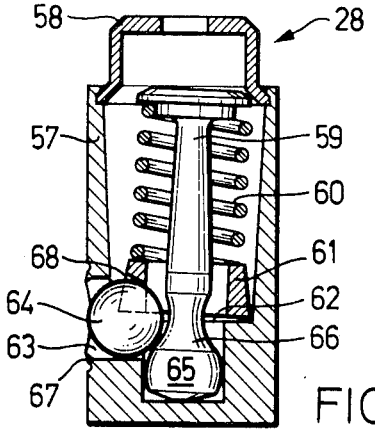

As will be seen by referring to FIGS. 8 to 10 a different exemplary embodiment of the safety element 28 contains a substantially cylindrical housing member 57 which is displaced through a cover member 58. Located in this housing member 57 is a substantially mushroom-shaped piston 59 which is pressed by a spring 60 against the cover 58 of the housing member 57. The spring 60 bears against a ring member 61 which is in contact with a shoulder 62 of the housing member 57. At the region of this shoulder 62 the housing member 57 possesses a non-continuous transverse bore 63 within which there is located a ball or spherical member 64. The piston 59 possesses at its lower end a substantially spherical-shaped enlarged portion 65 and above the same a convex neck 66. By means of the enlarged portion 65 of the piston 59 the ball 64 is pressed against a bordered or flanged edge 67 at the outer end of the bore 63 (FIG. 8), so that the ball 63 can protrude out of the housing member 57 and extend into the recess 56 of the rotor 21 (FIG. 3). The ring or ring member 61 possesses a recess 68 into which partially protrudes the ball 63, as will be particularly evident by reverting to FIG. 9. The ring member 61 is configured so it has an external conical shape, so that it, as shown in FIG. 10, can be obliquely or inclinedly positioned, for instance under the action of a centrifugal force, against the force of the spring 60. With inclined position of the ring 61 it is possible for the ball 64, as shown in FIG. 10, to be pressed against the neck 66 of the piston 59, so that the ball 64 no longer protrudes out of the housing member 57.

The operation of the acceleration safety element 28 shown in FIGS. 8 to 10 is as follows:

Upon firing of the projectile in which there is arranged the base fuze with the described acceleration safety element 28, the piston 59, under the action of the firing acceleration, is pressed downwardly into the position of FIG. 9 against the force of the spring 60. The spring 60 thus presses the ring 61 against the ball 64. As soon as the spin exceeds a threshold value, then the ball 64 is pressed against the neck 66 of the piston 59 against the force of the spring 60, and thus, no longer protrudes into the recess 56 of the rotor 21, so that such rotor can rotate into its armed or live position.

Figure 11:
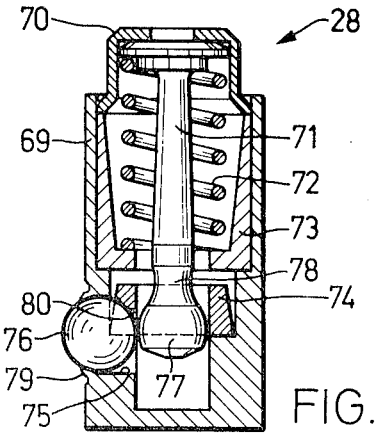
FIG. 11 is a longitudinal sectional view through a third exemplary embodiment of an acceleration safety element.
Figure 12:
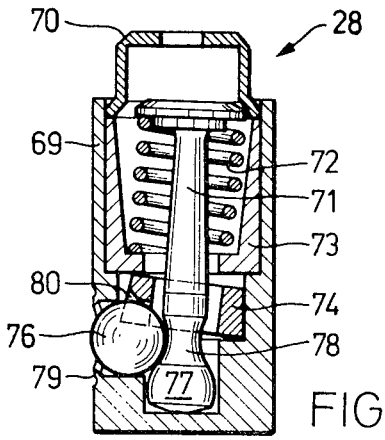
FIG. 12 illustrates the acceleration safety element shown in FIG. 11 in a different position.

Turning attention now to FIGS. 11 and 12 there is depicted a further exemplary embodiment of the safety element 28 which will be seen to contain a substantially cylindrical housing member 69 which is closed by a cover member or cover 70. Within this housing member 69 is arranged a substantially mushroom-shaped piston 71 which is pressed by a spring 72 against the cover 70 of the housing member 69. The spring 72 bears upon a sleeve or sleeve member 73 which is rigidly anchored in the housing member 69. Located below the sleeve 73 is a ring 74 in the housing member 69. At the region of this ring or ring member 74 the housing member 69 possesses a non-continuous transverse bore 75 in which there is located a ball or spherical member 76. The piston 71 possesses at its lower end a substantially spherical-shaped enlarged portion 77 and above the latter a convex neck 78. By means of the enlarged portion 77 of the piston 71 the ball or spherical member 76 is pressed against a flanged or bordered edge 79 at the outer end of the transverse bore 75 (FIG. 11), so that the ball 76 protrudes out of the housing member 69 and protrudes into the recess 56 of the rotor 21 (FIG. 3). The ring member or ring 74 possesses a recess 80 into which partially protrudes the ball member 76, as best seen by referring to FIG. 11. The ring 74 is constructed so that it possesses an externally conical configuration and can be obliquely or inclinedly positioned, for instance under the action of the centrifugal force. With inclined position of the ring 74, as shown in FIG. 12, the ball 76 can be pressed against the neck 78 of the piston 71, so that the ball 76 no longer protrudes out of the housing 69.

The operation of the acceleration safety element 28 of FIGS. 11 and 12 is essentially the same as the operation of the acceleration safety element described and shown in conjunction with FIGS. 8 to 10. The only difference is that the ring 74 must not be inclinedly positioned against the force of the spring 72, and thus, can move into its inclined or oblique orientation much more easily.

Figure 13:
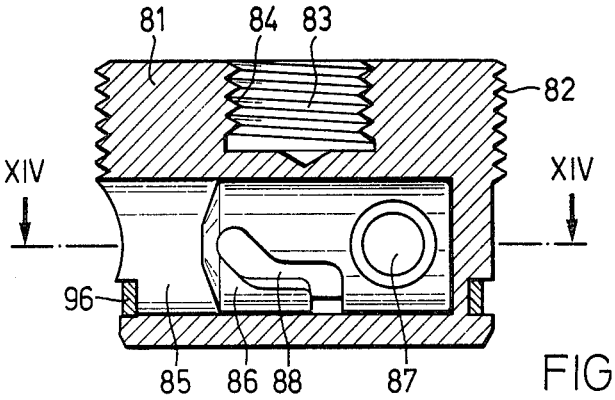
FIG. 13 is a sectional view, taken along the line XIII—XIII of FIG. 14, through a second exemplary embodiment of a safety apparatus for the base fuze depicted in FIG. 1.
Figure 14:
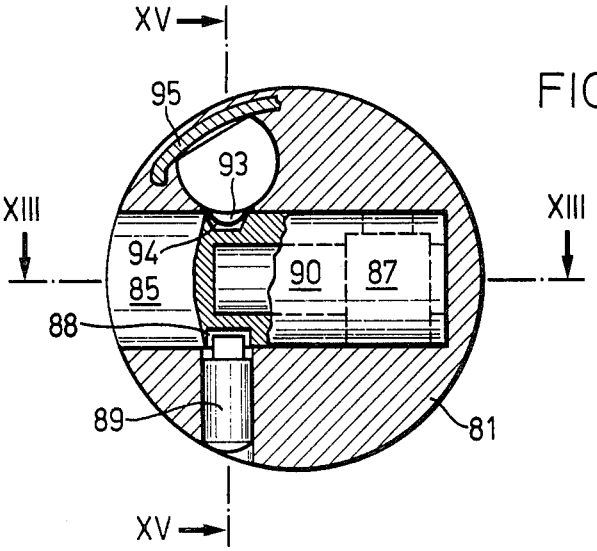
FIG. 14 is a sectional view, taken along the line XIV—XIV of FIG. 13.
Figure 15:
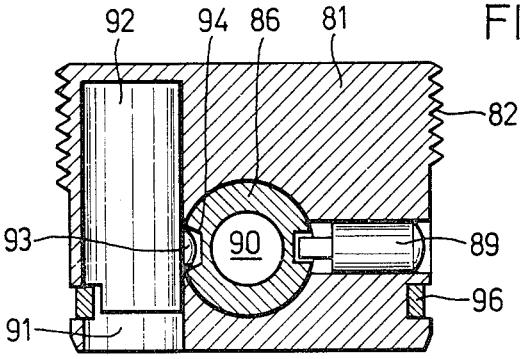
FIG. 15 is a sectional view taken along the line XV—XV of FIG. 14.

Turning attention now to FIGS. 13 to 15 a second exemplary embodiment of safety apparatus will be seen to comprise a housing 81 of substantially cylindrical configuration and having external threads 82 in order to be able to be threaded into the fuze housing 10 of the base fuze of FIG. 1. The housing 81 possesses a first non-continuous bore 83 having internal threads 84 and arranged coaxially with respect to the fuze axis. Within the bore 83 there can be threaded the reinforcement charge 14 shown in FIG. 1. Furthermore, the housing 81 possesses housing means for the safety elements. A first housing member thereof forms a second non-continuous bore 85 which is arranged transversely with respect to the fuze axis. Located in this second bore 85 is a substantially cylindrical rotor 86. The rotor 86 is arranged to be rotatable and displaceable in the bore 85 of the housing 81. This rotor 86 contains a detonator cap 87 and possesses at its cylindrical surface a screw or helical-shaped groove 88 into which protrudes a bolt member 89 as shown in FIGS. 14 and 15. This bolt 89 in conjunction with the groove 88 ensures that, upon displacement of the rotor 86 towards the left of the illustration of FIG. 13, this rotor 86 is rotated through 90° about its own axis. Consequently, the detonator cap 87 reaches a position below the bore 83, and the axis of the detonator cap 87 is disposed coaxially with respect to the axis of the bore 83. An inertia body or mass 90 located within the rotor 86 ensures that the spin forces, upon firing of the weapon, shift the rotor 86 towards the left of the showing of FIG. 13. The wall between the bore 85 and the bore 83 in FIG. 13 is so thin that the detonator cap 87 can ignite the reinforcement charge 14 within the bore 83.

The housing 81 possesses another housing member of the housing means which forms a third non-continuous bore 91 parallel to the bore 83 (FIG. 15) and within which there is located an acceleration safety element 92 like the element 28 of the arrangement of FIG. 7, 8 or 11. This acceleration safety element 92 possesses a ball or spherical member 93 which corresponds to the ball 46 of the showing of FIG. 7 or the ball 64 of FIG. 8 or the ball 76 of FIG. 11. This ball 93, as shown in FIGS. 14 and 15, protrudes into a recess 94 of the rotor 86 and secures such against a premature displacement in the described manner. A blade or leaf spring 95 or equivalent structure of FIG. 14 secures the safety element 92 against rotation and a ring spring 96 in FIG. 15 secures the safety element 92 against displacement.

The operation of the safety apparatus according to FIGS. 13 to 15 is as follows:

Upon firing of the projectile the acceleration safety element 92 is released by the firing acceleration, as the same has been described above in conjunction with FIGS. 7, 8 to 10 and 11 to 12. By virtue of the spin of the projectile the rotor 86 moves towards the left of the showing of FIG. 13, and thus, is rotated by the bolt 89 and the helical groove 88 through 90°. As explained, the ignition or detonator cap 87 thus assumes an armed position and can be ignited by the electronic elements 16 shown in FIG. 1, so that the reinforcement charge 14 of FIG. 1 is then ignited.

Figure 16:
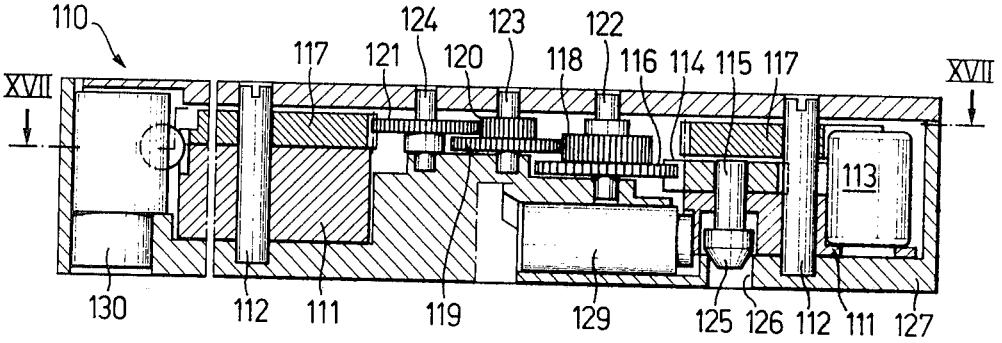
FIG. 16 is a sectional view through a third exemplary embodiment of the safety apparatus taken along the line XVI—XVI of FIG. 17 and shown in its safety position, wherein the sectional view has been portrayed such that individual elements or parts have been twice illustrated.

According to the showing of FIGS. 16 to 20 thus safety apparatus 110 contains a rotor 111 (FIG. 17) mounted to be rotatable about a shaft 112 in a housing 127. Attached in this rotor 111 is a detonator cap 113 or equivalent structure. Furthermore, there is rotatably mounted in the rotor 111 a swinging or oscillating armature 114, as particularly evident by referring to FIG. 19. This swinging or oscillating armature 114 is rotatable about a bolt 115 or the like which is arranged displaceably in the rotor 111 and which, in the showing of FIG. 16, is in its lowermost position and in the showing of FIG. 19 is shown in its uppermost position. In the safety position of the rotor 111 the axis of the bolt 115 coincides with the spin axis of the projectile, as apparent from FIG. 20.

The swingable or oscillatable armature 114 which is pivotable about the pivot bolt 115 coacts with a gear 116 or equivalent structure. In conventional manner during each pivotal movement of the swingable armature 114 the gear 116 is indexed by one gear tooth. This gear 116 is driven by a toothed segment 117 (FIGS. 16, 17 and 18) by means of a gearing or drive which is composed of four gears 118, 119, 120 and 121. The gear 118 is fixedly connected with the gear 116. Both of the gears 116 and 118 are rotatably mounted about a shaft 122. The gears 119 and 120 are likewise rigidly interconnected with one another and rotatably mounted about a shaft 123, and, on the one hand, the gear 119 meshes with the gear 118 and, on the other hand, the gear 120 meshes with the gear 121. The gear 121 is rotatable about a shaft 124 and meshes with the toothed segment 117.

Figure 17:
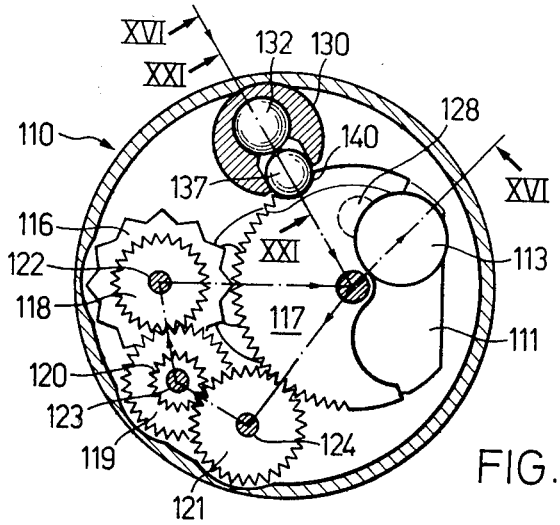
FIG. 17 is a sectional view taken along the line XVII—XVII of FIG. 16 and showing the safety apparatus in its safety position or state.
Figure 18:
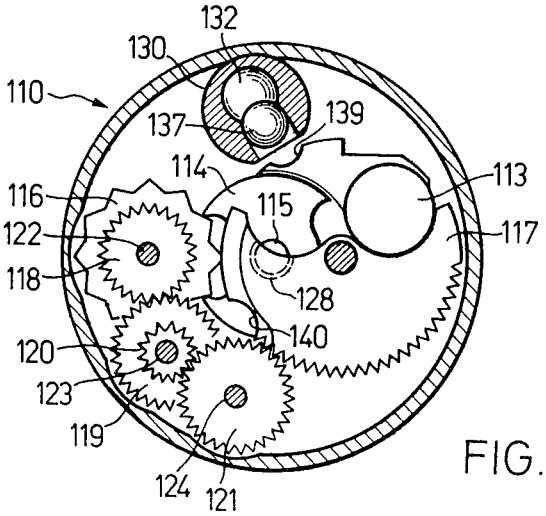
FIG. 18 is the same sectional view along the lines XVII—XVII of FIG. 16 showing the safety apparatus in its safety position.

After firing of the projectile the toothed segment 117, under the action of the projectile spin, rotates out of the position of FIG. 17 into the position of FIG. 18 and thus drives, by means of the gears 121, 120, 119 and 118 the gear 116, with the result that the pivotable swinging armature 114 is rocked back-and-forth. The toothed segment 117 is mounted upon the shaft 112 independent of the rotor 111. As will be evident by reverting to FIGS. 16 and 18, the toothed segment 117, during its rotation in the counterclockwise direction, impacts against the detonator cap 113 and strives to rotate the rotor 111 likewise in the counterclockwise direction. The above-mentioned bolt 115 protrudes by means of its cone-shaped head 125 into a bore 126 in the housing 127 (FIG. 16), so that the rotor 111 is secured against any unintentional rotation. As soon as the toothed segment 117 arrives at the position shown in FIG. 18, then a bore 128 provided at the toothed segment 117 is located above the bolt 115, so that such, as shown in FIG. 19, can be displaced upwardly into this bore 128. The displacement of the bolt 115 is caused, on the one hand, by virtue of the fact that due to the action of the projectile spin the rotor 111 strives to rotate in the clockwise sense. Hence, the head 125 of the bolt 115 is pressed by means of its conical surface against the edge of the bore 126 of the housing 127, so that the bolt 115 is displaced upwardly into the bore 128 of the toothed segment 117 (FIG. 19). On the other hand, due to the air resistance the projectile is retarded or delayed, so that the bolt 115 anyway strives to move forwardly, i.e. upwardly in the showing of the drawings.

Continuing, it will be appreciated that the rotor 111 is secured against rotation, prior to firing of the projectile, by two safety elements 129 and 130 contained in housing means. As to these safety elements 129 and 130 the first safety element 129 is responsive to projectile spin in order to release the rotor 111 in its armed position. The second safety element 130 is responsive to the firing acceleration and the projectile spin for releasing the rotor 111 in its armed position.

The construction of the second safety element 130 will be apparent from FIGS. 21 and 22. According to the showing of FIGS. 21 and 22 the safety element 130 comprises a substantially cylindrical housing member 131 in which there is located within a lengthwise bore a ball or spherical member 132 and pressed by the action of a spring 133 against a displaceable and tiltable ring-shaped disc 134 or the like. This disc 134 bears, in turn, at a substantially plate-shaped cover member 135 of the housing member 131.

At the region of the ball 132 the housing member 131 possesses a transverse bore 136 within which there is located a second smaller ball or spherical member 137. At the outer end of the transverse bore 136 there is provided a flanged portion or border 138 which prevents that the second ball 137 can drop out of the transverse bore 136 of the cylindrical housing member 131. As will be apparent from FIGS. 17, 18 and 20 the smaller ball 137 can protrude into a recess 139 of the rotor 111 (FIG. 20) and also into a recess 140 of the toothed segment 117 (FIG. 17), wherein, according to FIG. 16, at the same time a part of the ball 137 protrudes into the recess 139 of the rotor 111 and another part of the ball 137 protrudes into the recess 140 of the toothed segment 117.

As will be particularly evident from the showing of FIG. 22 due to the firing acceleration and the inertia of the ball 132 the spring 133 is compressed. Consequently, the first ball 132 is downwardly moved within the housing member 131. At the same time the ring-shaped disc 134, by virtue of its mass moment of inertia, presses during the entire time that the projectile passes through the weapon barrel, against the ball 137 and retains such in its blocked position. At the weapon barrel end, due to the spin of the projectile, the second ball 137 is pressed against the first ball 132 and against the ring-shaped disc 134 or the like, and as a result the ball 137 no longer protrudes into the aforementioned recesses 139 and 140 of the rotor 111 and the toothed segment 117, respectively. Equally, due to the action of the projectile spin the ball 132 slides into a lateral recess and remains at that location. Consequently, the rotor 111 and the toothed segment 117 are no longer secured against location into the armed position by the safety element 130.

Figure 23:
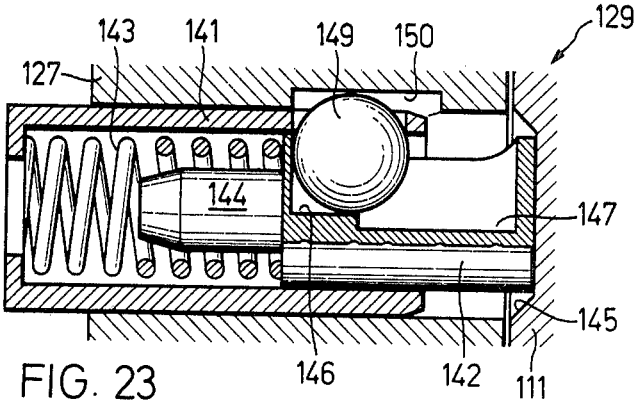
FIG. 23 is a longitudinal sectional through a spin safety element taken along the line XXIII—XXIII of FIG. 19.
Figure 24:
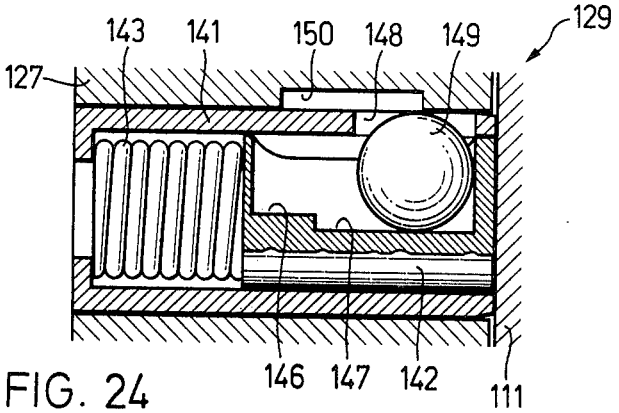
FIGS. 24 and 25 illustrate the same longitudinal section through the spin safety element in different respective positions.
Figure 25:
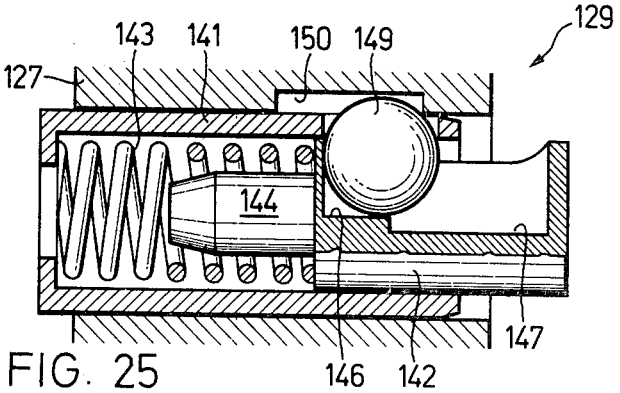

According to FIGS. 23 to 25 the spin safety element 129 possesses a housing member forming a sleeve 141 in which there is displaceably guided a piston 142. A spring 143 strives to move the piston 142 within the sleeve 141 towards the right of the showing of FIG. 23. This spring 143 bears, at one end, at the base of the sleeve 141 and, at the other end, at the end surface or face of the piston 142. A pin 144 or equivalent structure provided for the piston 142 protrudes into the interior of the spring 143. The sleeve 141 is located within a not particularly referenced bore of the housing 127 and such bore contains an opening 150. The piston 142 possesses two recesses 146 and 147. The right-hand recess 147 is deeper than the left-hand recess 146 shown in FIGS. 23 to 25. The sleeve 142 possesses a transverse bore 148 which is slightly conical and contains a ball or spherical member 149 which partially protrudes through the transverse bore 148. As best seen by referring to FIG. 23, the ball 149 protrudes out of the sleeve or sleeve member 141 and extends into the opening 150 of the housing 127, since it is located at the left-hand illustrated less deep recess 146 of the piston 142. However, if as shown in FIG. 24 the ball 149 is located at the right-hand illustrated deeper recess 147 of the piston 142, then it still protrudes into the transverse bore 148 of the sleeve 142, but no longer into the opening 150 of the housing 127. As shown in FIG. 23 the piston 142 protrudes into a recess 145 of the rotor 111. FIG. 24 illustrates the situation where the piston 142 bears upon an improperly inserted rotor 111. As shown in FIG. 25 the rotor 111 is missing and the piston, during the assembly work can penetrate to such an extent into the space provided for the rotor 111 until the ball 148 bears at an edge of the opening 150 of the housing 127.

If the rotor 111, during the assembly of the entire safety apparatus, has erroneously not been inserted into the housing 127, then it is also impossible to insert the spin safety element 129, since upon insertion of the spin safety element 129 into the bore of the housing 127 the ball 149 impacts against the edge of the opening 150 and prevents a complete introduction of the sleeve 141, as will be evident by referring to FIG. 25. However, if the rotor 111 has been inserted as shown in FIG. 23, then also the spin safety element 129 can be completely introduced into the housing 127. However, if the rotor 111 has been improperly introduced or inserted into the housing 127, then the spin safety element 129 cannot be inserted as usual, since now the spring 143 would have to be compressed together more intensely than otherwise would be the case, as will be apparent from the illustration of FIG. 24. This improper position is visible from the outside and can be measured, and specifically by virtue of the position of the pin 144 or the like. Upon firing of the projectile due to the projectile spin the piston 142, according to FIGS. 23 and 24, is shifted towards the left to such an extent that it no longer protrudes into the recess 145 of the rotor 111, so that the rotor 111 can freely rotate until it arrives in its armed or live position.

While there are shown and described present preferred embodiments of the invention, it is to be distinctly understood that the invention is not limited thereto, but may be otherwise variously embodied and practiced within the scope of the following claims. Accordingly,

I claim:

1. A safety apparatus for use with a spinning projectile containing a reinforcement charge and a fuze, comprising:

a rotor having a rotor axis;

said rotor, upon firing of the projectile, being movable out of a blocking position into an armed position and the rotor axis being mounted externally of the spin axis of the projectile;

a restraining mechanism cooperating with said rotor;

said restraining mechanism releasing the rotor, after firing of the projectile and following a time delay, to enable said rotor to rotate into the armed position;

a first safety element cooperating with said rotor;

said first safety element responding to the firing acceleration and the spin of the projectile, in order to release the rotor for its rotation into the armed position;

a second safety element cooperating with said rotor;

said second safety element responding to the spin of the projectile in order to release the rotor for its rotation into the armed position;

a housing accommodating said rotor, said restraining mechanism, said first and said second safety element and forming a structural unit placed intermediate the fuze and the reinforcement charge in the assembled state of the spinning projectile;

housing means within which there are arranged said safety elements; and said housing means for said safety elements being mountable as a unit in said housing.

2. The safety apparatus as defined in claim 1, wherein:

said spin safety element is constructed such that improper assembly of the spin safety apparatus is immediately visibly discernible.

3. The safety apparatus as defined in claim 1, wherein:

said restraining mechanism comprises an oscillatable armature;

said oscillatable armature having a pivot shaft which essentially coincides with the axis of spin of the projectile;

a toothed segment cooperating with said rotor and meshing with said restraining mechanism;

said toothed segment acting on said rotor to assist rotation thereof under the action of projectile spin force;

said first safety element comprising a ball displaceable by the firing acceleration; and said second safety element comprising a piston displaceable by the projectile spin.

4. The safety apparatus as defined in claim 3, wherein:

said second safety element containing, apart from said ball, a displaceable an tiltable disc.

5. The safety apparatus as defined in claim 3, further including:

a bolt member for securing the rotor and simultaneously constituting the pivot shaft for the oscillatable armature.

6. The safety apparatus as defined in claim 3, further including:

impact means provided at said toothed segment for enabling entrainment of said rotor.

7. The safety apparatus as defined in claim 1, further including:

a shaft for rotatably mounting said rotor about an axis extending essentially parallel to the projectile axis;

said housing means of said safety elements comprising a respective cylindrical housing member in each of which there is arranged one of said safety elements;

one of the housing members having an axis extending substantially parallel to the projectile axis;

the other housing member having an axis extending radially with respect to the projectile axis; and both of said housing members of the safety elements being arranged in said housing.

8. The safety apparatus as defined in claim 7, wherein:

one of said housing members for the safety elements serves to house the spin safety element;

said one housing member for the spin safety element being provided with a spring-loaded piston;

said rotor having a bore into which there can be displaced said piston;

spring means acting upon said piston;

said piston being displaceable out of the bore of the rotor against the force of the spring means by the projectile spin;

said piston being provided with recesses;

a blocking body coacting with said recesses;

said recesses defining a first recess, a second recess and a third recess;

said housing member of said spin safety element containing a bore;

said blocking body protruding out of the first recess into the bore of the housing member;

the housing of the safety apparatus being provided with a shoulder against which bears said blocking body;

said blocking body protruding out of said second recess of the piston only into the bore of the housing; and said blocking body when in said third recess being located completely in said third recess of the piston.

9. The safety apparatus as defined in claim 7, wherein:

one said housing member serves for housing the safety element constituting the acceleration safety element;

a displaceable piston arranged in said one housing;

spring means acting upon said displaceable piston;

said one housing member being provided with a transverse bore;

a blocking body located in said transverse bore;

said rotor having a recess into which there can be displaced said blocking body;

said piston being capable of assuming a first position where the blocking body protrudes into the recess of the rotor; and said transverse bore being inclined in a manner such that the blocking body is pressed against the rotor due to the projectile acceleration.

10. The safety apparatus as defined in claim 9, wherein:

said spring means bears against said piston;

a ring member for supporting said spring means at said blocking body; and said spring means striving to press the blocking body against the rotor.

11. The safety apparatus as defined in claim 9, further including:

a ring surrounding said piston and against which bears said blocking body; and said ring pressing the blocking body against the rotor under the action of the acceleration force.

* * * * *